United States Patent [19]

Kuminitsu et al.

[11] 4,439,237

[45] Mar. 27, 1984

[54] METALLURGICALLY BONDED DIAMOND-METAL COMPOSITE SINTERED MATERIALS AND METHOD OF MAKING SAME

[75] Inventors: Shiro Kuminitsu, Kawasaki; Izumi Hayakawa, Tokyo; Seizo Kitatani, Ina; Akira Emura, Tokyo, all of Japan

[73] Assignee: Mitsui Mining & Smelting Co., Ltd., Tokyo, Japan

[21] Appl. No.: 305,751

[22] Filed: Sep. 25, 1981

Related U.S. Application Data

[63] Continuation of Ser. No. 51,179, Jun. 22, 1979, abandoned.

[30] Foreign Application Priority Data

Jun. 27, 1978 [JP] Japan ..... 53-77787

[51] Int. Cl.[3] ..... B22F 3/00

[52] U.S. Cl. ..... 75/243; 419/11; 419/46

[58] Field of Search ..... 75/243, 201, 203, 204; 419/11, 46

[56] References Cited

U.S. PATENT DOCUMENTS

| | | | |
|---|---|---|---|
| 2,173,834 | 9/1939 | Fitz-Randolph | 75/243 |
| 2,173,835 | 9/1939 | Boyer et al. | 75/243 |
| 2,270,209 | 1/1942 | Vander Pyl | 75/243 |
| 3,650,714 | 3/1972 | Farkas | 75/243 |
| 3,819,814 | 6/1974 | Pope | 75/201 |

*Primary Examiner*—Brooks H. Hunt

*Attorney, Agent, or Firm*—Flynn, Thiel, Boutell & Tanis

[57] ABSTRACT

A metallurgically bonded diamond-metal composite sintered material suitable for lapping comprises a Ni and/or Co base, an intermetallic compound dispersed in said base and diamond powder, and the method of making said material comprises specifying the particle size of the base powder and then sintering same at a low temperature not exceeding a diamond graphitization temperature.

8 Claims, 5 Drawing Figures

METALLURGICALLY BONDED DIAMOND-METAL COMPOSITE SINTERED MATERIALS AND METHOD OF MAKING SAME

This is a continuation of application Ser. No. 51 179, filed June 22, 1979 now abandoned.

BACKGROUND OF THE INVENTION (a) Field of the Invention

The present invention is directed to a metallurgically bonded diamond-metal composite sintered material suitable in particular for lapping and method of making same.

(b) Description of the Prior Art

In the art of lapping spectacle or optical lenses, metallurgically bonded diamond-metal composite sintered materials have recently come into the limelight and among them copper-tin base alloy diamond-metal composite sintered materials have widely been used for that purpose. However, the copper-tin base alloy diamond-metal composite sintered materials are defective in that their lapping lives are exceedingly short and they are liable to seriously injure the surfaces to be lapped owing to diamond powder falling off during lapping operations. On the other hand, nickel, cobalt, iron, etc. or these base alloy diamond-metal composite sintered materials are defective in that due to their high melting points they can not be sintered sufficiently unless they are sintered at a temperature over 1000° C., whereby the diamonds used are liable to rapid graphitization and consequently their characteristics are destroyed.

In order to eliminate the aforesaid deficiencies inherent to the nickel base diamond-metal composite sintered material, some of the present inventors have tried and succeeded in sintering at a low temperature, at which the diamonds used are free from graphitization, by making the particle size of the nickel powder relatively finer, and have proposed to provide a sintered material superior in the diamond-holding force as well as lapping performance (Japanese Patent Application No. 159153/1976).

However, this nickel base diamond-metal composite sintered material has proved inferior in the maintenance of lapping force because it shows gradual clogging phenomena and is deteriorated in lapping performance in the course of long-run operation.

SUMMARY OF THE INVENTION

The present invention is directed to a sintered material comprising a Ni and/or Co base, an intermetallic compound dispersed in said base by the addition of an element capable of forming said intermetallic compound together with the base and diamond powder. This sintered material, including the hard and brittle intermetallic compound dispersed in the base, is free from clogging phenomena in the long-run lapping operation to thereby maintain its lapping performance, and consequently can meet all the requirements for the lapping material, for instance, such as diamond-holding force, maintenance of lapping accuracy, prevention of lapping streaks, life, etc. Therefore, the sintered material according to the present invention is most suitably used for lapping spectacle and optical lenses, prisms, I.C. boards, surface glasses of watches, marbles, etc. In addition, the present invention is directed to a method of making metallurgically bonded diamond-metal composite sintered materials which comprises mixing 100 mesh or less of base Ni and/or Co powder with 0.1–10 wt.% of 1–40μ diamond powder and an element capable of forming the intermetallic compound together with the base powder, pressure molding this mixture and then sintering same in a non-oxidizing atmosphere at a temperature of 600°–950° C. for 15 minutes–1 hour. This method permits the production of the above-mentioned metallurgically bonded diamond-metal composite sintered material most suitable for lapping which is obtained through sintering at a low temperature and is freed from graphitization of diamond.

BRIEF DESCRIPTION OF THE DRAWING

FIG. 1 illustrates the relation between the number of lapped sheets of sintered materials containing tin in varied quantities and the lapping loss of lens wherein the solid line indicates the Ni-0%Sn base sintered material, the dash-dot line indicates the Ni-20%Sn base sintered material, and the broken line indicates the Ni-30%Sn base sintered material;

FIG. 2 illustrates the relation between the quantity of tin added and the lapped quantity dropping percentages;

FIG. 3 illustrates the relation between the quantity of tin added and the lapping ratio wherein the symbol indicates a Cu-Sn base sintered material;

FIG. 4 illustrates the relations in the lapping time and accumulated lapped quantity between the Ni-25%Sn base sintered material of the present invention and the Cu-Sn base sintered material (Control) wherein the solid line indicates the sintered material of the present invention and the dash-dot line indicates the control sintered material;

FIG. 5 illustrates the relation between the quantity of phosphorus added to the Ni-diamond-0.1%S base sintered material and the lapping ratio thereof.

DETAILED DESCRIPTION OF THE INVENTION

Figure 1:
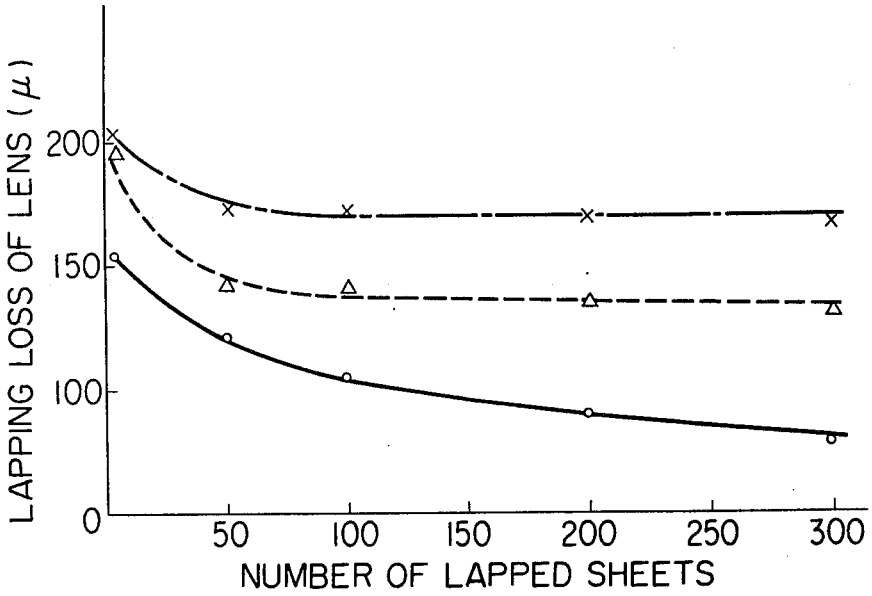
FIG. 1–FIG. 4 illustrate the test results in Example 1.
Figure 2:
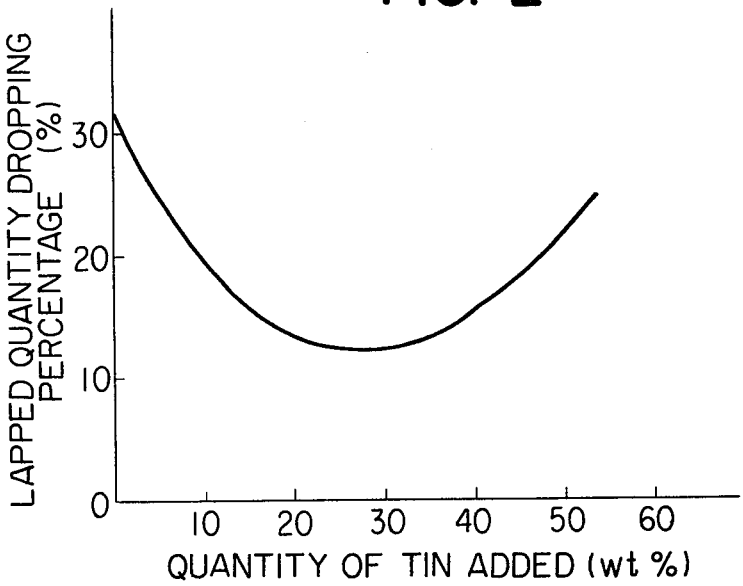
Figure 3:
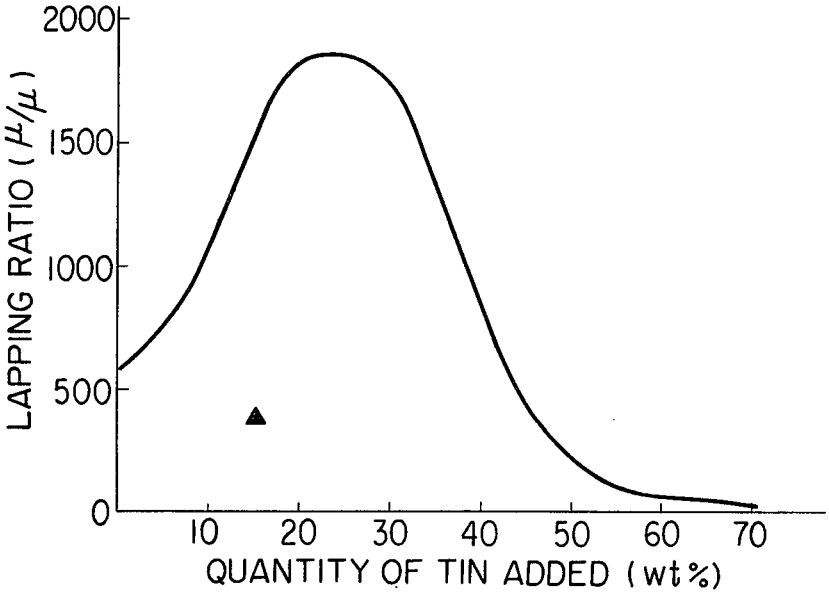

The base powder suitably used in the present invention includes nickel powder and/or cobalt powder. As the nickel powder, there can be suitably used carbonyl nickel, reduced nickel and electrolytic nickel, and as the cobalt powder, there can be suitably used reduced cobalt and so forth. The particle size of these nickel or cobalt powder used should be 100 mesh or less respectively.

As for the diamond powder, 1μ–40μ diamond powder is mixed in a quantity of 0.1–10 wt.%. This diamond powder may be a simple substance or a substance whose surface has been coated with nickel, cobalt, copper, tin or the like, preferably a marketably available electroless nickel-plated diamond powder. The sintered material using such coated diamond powder may be further improved in its strength.

And, as the element capable of forming the intermetallic compound together with the base there may be enumerated tin, antimony, zinc, phosphorus, sulfur, magnesium, titanium, molybdenum, selenium, germanium, indium, tellurium, vanadium, niobium, tantalum, boron and so forth. It is essential that these elements should be added in such quantities that the intermetallic compound to be formed by the reaction of the added element with the base powder may be dispersed in the base uniformly as well as in a quantity enough to enhance the lapping operation. In order to achieve this end, it is necessary to add these elements depending on the specific gravity thereof. In view of aforesaid elements being classified, based on the differences in specific gravity, into two groups, i.e., one group consisting of tin, antimony, zinc, selenium, germanium, etc., the other group consisting of phosphorus, sulfur, magnesium, etc., when adding the element of the former group in a quantity of 5–40 wt.% and the element of the latter group in a quantity of 0.2–3 wt.% the intermetallic compound comes to disperse in a proper quantity. In this connection, it is to be noted that these elements are usually added singularly but may be added in the combination of two or more.

The base powder, diamond powder and an intermetallic compound-forming element are mixed together, and if needed, a small quantity of lubricating agent to be used at the time of molding, for instance, such as zinc stearate, lithium stearate, etc. may be further added, to obtain a mixture. The mixture is press molded by means of a predetermined mold to obtain a compact, the density of which is preferably in the range of 4–6.5 g/cc. Next, this compact is sintered at a temperature of 600°–950° C. for 15 minutes–1 hour in a non-oxidizing atmosphere, for instance, such as vacuum, hydrogen gas, nitrogen gas, argon gas, etc. In this case, when the sintering conditions are milder, sintering can not be effected sufficiently, and when the sintering conditions are more severe, the graphitization of diamond is called into question. If needed, the sizing dimension of the obtained sintered material may be corrected.

In effecting the sintering operation, as the particle size of the base powder is regulated to be relatively fine, sintering can be effected sufficiently even at a temperature of about 600°–950° C., which is lower than the temperature at which the diamond powder undergoes rapid graphitization, i.e., 1000° C. In addition, as the temperature at which the intermetallic compound is formed by the cooperation between the base powder and the intermetallic compound-forming element is lower than that in the case where the base powder alone is used therefor, the formation of the intermetallic compound also serves to lower the sintering temperature. Of the intermetallic compound-forming elements, tin, antimony, zinc, phosphorus and sulfur each have a relatively low melting point. Therefore, these elements do melt and disperse even at the low temperature at which the sintering operation of the present invention is carried out, and cooperate readily with the base to form the intermetallic compounds. Moreover, cavities remain after the intermetallic compound-forming element has melted and dispersed, and enhance the removal of shavings coming out from the lapping. And the volume of the cavities can also be controlled by regulating the quantities of low melting elements. In view of this, it is preferable to use these low melting elements as the intermetallic compound-forming element. And, it is particularly preferred that nickel powder be employed as the base powder and tin as the intermetallic compound-forming element. It is needless to say that the other relatively high melting elements can also serve to form and disperse the intermetallic compound as mentioned above and further to lower the sintering temperature, thereby achieving the effects intended by the present invention.

The intermetallic compound thus obtained is hard and brittle, and therefore the sintered material in which said compound has dispersed is itself hard, increased in abrasion resistance and further improved in diamond-holding force. In lapping, owing to its self-dressing effect, clogging is prevented for a long period of time, and consequently its lapping force-retaining property is exceedingly improved.

In the case of the lapping operation using the aforesaid metallurgically bonded diamond-metal composite sintered material, the diamond powders dispersed in the metal matrix become lapping edges to thereby perform the lapping operation, wherein the contact pressure between the sintered material and the material to be lapped and the number of lapping edges have a close bearing on the lapping efficiency. And, in the case where a relatively low load of 30–500 g/cm$^2$ or so is required in particular such as lapping of prisms, I.O. boards and the like, the quantity of the diamond powder preferably should be controlled to be in the range of 0.1–1 wt.% because the number of lapping edges is thereby made proper and consequently the pressure to be loaded on each lapping edge becomes proper. It is more preferable than this case that the quantity of diamond powder should be controlled to be in the range of 0.1–0.6 wt.%.

Hereinafter will be shown Examples for embodying the present invention.

EXAMPLE 1

To a mean particle size 3μ–4μ carbonyl nickel powder was added 1 wt.% of 10μ–20μ artificial diamond powder, followed by the addition of −250 mesh tin in the varied quantities of from 0 to 70 wt.% to obtain mixtures respectively. To these mixtures was further added 0.5 wt.% of zinc stearate. The resulting mixtures were press molded using a metal mold into diameter 10×height 3 tablet-like compacts with a compact density of about 6 g/cc. These compacts were sintered in a mixed gas of $H_2$ and $N_2$ at 840° C. for 45 minutes to obtain sintered materials. The resulting sintered materials were applied for lapping optical lenses with Mohs' hardness of 6 to obtain the results as shown in FIG. 1, FIG. 2, FIG. 3 and FIG. 4.

Figure 4:
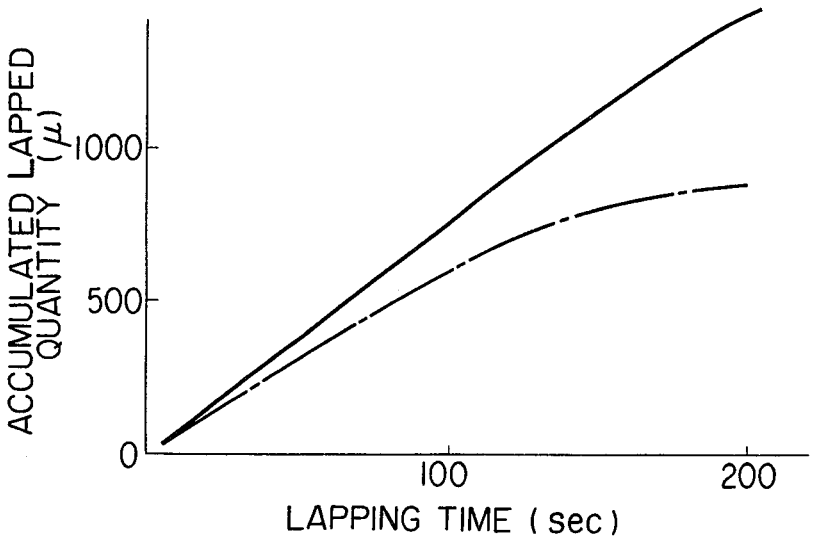

It is noted from these results that in the case tin is not added to the nickel-diamond there is a tendency that the lapping loss of lens decreases as the number of lapped pieces increases, while in the case of the sintered material according to the present invention the lapped quantities do not decrease and moreover the lapping ratio (abrasion loss of lens/abrasion loss of sintered material ratio) remarkably increases. As shown in FIG. 4, the accumulated lapped quantities decreased with lapse of time in the control sintered material but progressed in a substantially linear manner in the sintered material of the present invention.

EXAMPLE 2

Figure 5:
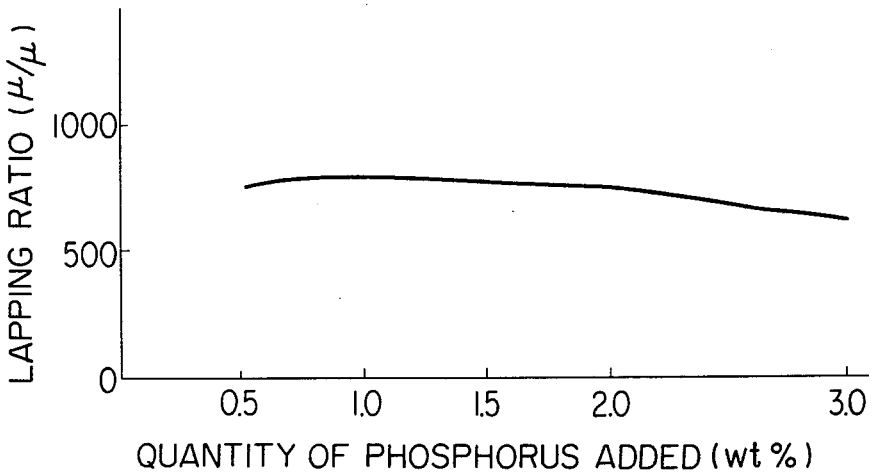
FIG. 5 illustrates those in Example 2.

To a mean particle 3μ–4μ carbonyl nickel powder was added 1 wt.% of 10μ–20μ artificial diamond powder, followed by the addition of 0.1 wt.% of sulfur and red phosphorus in the varied quantities of from 0.5 to 3 wt.%. To these mixtures was further added 0.5 wt.% of zinc stearate. The resulting mixtures were molded according to the same procedure of Example 1 and sintered. The obtained sintered materials were applied for lapping optical lenses with Mohs' hardness of 6 to obtain the lapping ratio. Consequently, the obtained result was as shown in FIG. 5.

EXAMPLE 3

To the mixed powder in which the ratio of a mean particle size −250 mesh or less electrolytic nickel with a mean particle size 3μ–4μ reduced cobalt powder has been regulated to be 3:7 were added 1 wt.% of 15μ–25μ diamond powder, and further 0.5 wt.% of red phosphorus and 0.3 wt.% of sulfur. The resulting mixture, upon addition of a predetermined lubricating agent, was molded according to the same procedure as Example 1 and sintered. The obtained sintered material was applied for lapping the optical lens with Mohs' hardness of 6 to compare the sintered material with the control copper-tin base sintered material in respect of mean lapped quantity and lapping ratio. The obtained results are shown in the following table.

| | Mean lapped quantities (μ) | Lapping ratio (μ/μ) |
|---|---|---|
| Sintered material according to the present invention | 204.1 | 2354.8 |
| Copper-tin base diamond-metal composite sintered material | 139.1 | 410.6 |

We claim:

1. A metallurgically bonded, sintered, diamond-metal composite, comprised of a matrix consisting essentially of a metal selected from the group consisting of nickel, cobalt and mixture thereof, diamond powder uniformly dispersed in said matrix and particles of hard, brittle, intermetallic compound uniformly dispersed in said matrix, said composite having been prepared by mixing powder of said matrix metal, said diamond powder and powder of substance capable of combining with said matrix metal to form said intermetallic compound, said substance being selected from the group consisting of tin, antimony, zinc and mixture thereof, the amount of said substance being from 5 to 40 wt.%, and then sintering the mixture until said intermetallic compound is formed.

2. A metallurgically bonded, sintered, diamond-metal composite, comprised of a matrix consisting essentially of a metal selected from the group consisting of nickel, cobalt and mixture thereof, diamond powder uniformly dispersed in said matrix and particles of hard, brittle, intermetallic compound uniformly dispersed in said matrix, said composite having been prepared by mixing powder of said matrix metal, said diamond powder and powder of substance capable of combining with said matrix metal to form said intermetallic compound, said substance being selected from the group consisting of phosphorus, sulfur and mixture thereof, the amount of said substance being from 0.2 to 3 wt.%, and then sintering the mixture until said intermetallic compound is formed.

3. A composite according to claim 1 or claim 2 wherein said powder of said matrix metal has a particle size of 100 mesh or less.

4. A composite according to claim 1 or claim 2 wherein said diamond powder has a particle size of 1μ to 40μ and the amount of said diamond powder is from 0.1 to 10 wt.%.

5. A composite according to claim 4, wherein the amount of said diamond powder is 0.1 to 1 wt.%.

6. A composite according to claim 5, wherein said matrix metal is nickel and said substance is tin.

7. A method of making a metallurgically bonded, sintered, diamond-metal composite, which consists essentially of the steps of forming a sinterable mixture by mixing from 0.1 to 10 wt.% of diamond powder having a particle size of 1μ to 40μ, with powder of a matrix metal having a particle size of 100 mesh or less and selected from the group consisting of nickel, cobalt and mixture thereof, and with powder of substance capable of combining with said matrix metal to form a hard, brittle intermetallic compound, said substance being selected from the group consisting of tin, antimony, zinc and mixture thereof, the amount of said substance being from 5 to 40 wt.%; press molding said sinterable mixture to form a shaped object; and then sintering said pressed object, in a non-oxidizing atmosphere, at a temperature of 600° C. to 950° C., for from 15 minutes to 1 hour, until said intermetallic compound is formed.

8. A method of making a metallurgically bonded, sintered, diamond-metal composite, which consists essentially of the steps of forming a sinterable mixture by mixing from 0.1 to 10 wt.% of diamond powder having a particle size of 1μ to 40μ, with powder of a matrix metal having a particle size of 100 mesh or less and selected from the group consisting of nickel, cobalt and mixture thereof, and with powder of substance capable of combining with said matrix metal to form a hard, brittle, intermetallic compound, said substance being selected from the group consisting of phosphorus, sulfur and mixture thereof, the amount of said substance being 0.2 to 3 wt.%; press molding said sinterable mixture to form a shaped object; and then sintering said pressed object, in a non-oxidizing atmosphere, at a temperature of 600° C. to 950° C., for from 15 minutes to 1 hour, until said intermetallic compound is formed.

* * * * *